US007344570B2

(12) United States Patent
Moncrieff et al.

(10) Patent No.: US 7,344,570 B2
(45) Date of Patent: Mar. 18, 2008

(54) METHOD FOR MANUFACTURING AN EMULSIFIED FUEL

(75) Inventors: Vaughn M. Moncrieff, Reno, NV (US); Jack L. Waldron, Reno, NV (US); Patrick Grimes, Reno, NV (US); Rudolf W. Gunnerman, Reno, NV (US)

(73) Assignee: Clean Fuels Technology, Inc., Reno, NV (US)

( * ) Notice: Subject to any disclaimer, the term of this patent is extended or adjusted under 35 U.S.C. 154(b) by 422 days.

(21) Appl. No.: 10/659,046

(22) Filed: Sep. 9, 2003
(Under 37 CFR 1.47)

(65) Prior Publication Data

US 2005/0000149 A1 Jan. 6, 2005

Related U.S. Application Data

(63) Continuation-in-part of application No. 09/938,753, filed on Aug. 24, 2001, now abandoned.

(51) Int. Cl.
*C10L 1/32* (2006.01)

(52) U.S. Cl. ..... 44/301; 44/302

(58) Field of Classification Search ..... 44/301, 44/302

See application file for complete search history.

(56) References Cited

U.S. PATENT DOCUMENTS

| | | | | |
|---|---|---|---|---|
| 3,416,320 | A | 12/1968 | Asher | 60/208 |
| 3,615,290 | A | 10/1971 | Nixon | 44/51 |
| 4,083,698 | A | 4/1978 | Wenzel et al. | 44/51 |
| 4,173,455 | A | 11/1979 | Fodor et al. | 44/51 |
| 4,687,491 | A | 8/1987 | Latty | 44/51 |
| 4,744,796 | A | 5/1988 | Hazbun et al. | 44/51 |
| 4,770,670 | A | 9/1988 | Hazbun et al. | 44/51 |
| 4,770,775 | A | 9/1988 | Lopez | 210/321.83 |
| 4,822,433 | A | 4/1989 | Cooper et al. | 149/2 |
| 5,535,708 | A | 7/1996 | Valentine | 123/25 C |
| 5,542,379 | A | 8/1996 | Kessler | 123/25 C |
| 5,584,894 | A | 12/1996 | Peter-Hoblyn et al. | 44/301 |
| 5,603,864 | A | 2/1997 | Silva et al. | 252/311.5 |
| 5,669,938 | A | 9/1997 | Schwab | 44/301 |
| 5,700,970 | A | 12/1997 | McNicol | 102/332 |
| 5,743,922 | A | 4/1998 | Peter-Hoblyn et al. | 44/301 |
| 5,920,031 | A | 7/1999 | Jahnke | 149/2 |
| 6,017,368 | A | 1/2000 | Steinmann | 44/302 |
| 6,068,670 | A | 5/2000 | Haupais et al. | 44/301 |
| 6,187,063 | B1 | 2/2001 | Gunnerman | 44/301 |
| 6,211,253 | B1 | 4/2001 | Marelli | 516/53 |
| 6,270,541 | B1 * | 8/2001 | Basu et al. | 44/448 |
| 6,443,661 | B1 | 9/2002 | Wathen | 405/262 |

OTHER PUBLICATIONS

J. Carey et al., "Improved High Internal Phase Emulsions Using Alkenyl Succinic Anhydride Based Emulsifiers", [Internet] http://www.lubrizol.com/Surfactants/italypaper.htm; pp. 1-8, Printed Aug. 7, 2001.

"Methods of Water Purification", by Osmonics Inc., *National Development*, pp. 1-5, Mar. 1, 1992, printed from Internet, wysiwyg://48/http://www.osmonics.com/products/Page716.html, printed Mar. 19, 2003.

* cited by examiner

*Primary Examiner*—Cephia D. Toomer
(74) *Attorney, Agent, or Firm*—Sierra Patent Group, Ltd.

(57) ABSTRACT

A method for manufacturing an emulsifier package is disclosed. The method comprises blending a flow of fuel soluble product, a flow of stabilizer, and a flow of water in a mixing vessel to form a mixture. Mixing the mixture in the mixing vessel and recirculating the mixture through the mixing vessel. Lastly, shearing the mixture with a shearing device at a rate of about 27,500 shears per second to about 87,500 shears per second. A method for manufacturing an aqueous fuel emulsion is also disclosed.

21 Claims, 2 Drawing Sheets

METHOD FOR MANUFACTURING AN EMULSIFIED FUEL

CROSS REFERENCE TO RELATED APPLICATIONS

This application is a continuation-in-part of U.S. patent application Ser. No. 09/938,753, filed Aug. 24, 2001 now abandoned.

BACKGROUND

The present invention relates to an aqueous fuel emulsifier package, and more particularly to a method of manufacturing the individual raw materials of a particular emulsifier package to create a superior aqueous fuel emulsion from a source of hydrocarbon fuel, a source of water, and a source of said aqueous fuel emulsifier package.

Recent fuel developments have resulted in a number of aqueous fuel emulsions comprised essentially of a carbon-based fuel, water, and various additives such as lubricants, emulsifiers, surfactants, corrosion inhibitors, cetane improvers, and the like. These aqueous fuel emulsions may play a key role in finding a cost-effective way for internal combustion engines including, but not limited to, compression ignition engines (i.e., diesel engines) to achieve the reduction in emissions below the mandated levels without significant modifications to the engines, fuel systems, or existing fuel delivery infrastructure.

Advantageously, aqueous fuel emulsions tend to reduce or inhibit the formation of nitrogen oxides (NOx) and particulates (i.e., combination of soot and hydrocarbons) by altering the way the fuel is burned in the engine. Specifically, the fuel emulsions are burned at lower temperatures than conventional fuels due to the presence of water. This coupled with the realization that at higher peak combustion temperatures more NOx are typically produced in the engine exhaust, one can readily understand the advantage of using aqueous fuel emulsions.

As is well known in the art, the constituent parts of such aqueous fuel emulsions have a tendency to separate or be unstable over time because of the different densities or relative weights of the primary components. As an example, middle distillate hydrocarbon sources have a density of approximately 0.85 while water sources have a density of approximately 1.0. Because the gravitational driving force for phase separation is more prominent for larger droplets of water, emulsions containing relatively smaller droplets of water will remain stable for longer periods of time. Aqueous fuel emulsion breakdown or phase separation is also influenced by how quickly the water droplets coalescence, flocculate or sediment. The emulsion breakdown is also influenced by the environment in which the aqueous fuel is subjected. For example, high temperatures and dynamic stress can accelerate the deterioration of the aqueous fuel emulsion. Given the high temperatures inherent to combustion devices and the related fuel delivery systems, aqueous fuel emulsions must be designed to withstand a prescribed amount of heat and stress. Any breakdown in the aqueous fuel emulsion can be extremely damaging if not detected before use in combustion. Given the microscopic nature of the suspended particles with the discontinued phase, aqueous fuel emulsions can look good to the naked eye but can actually be considered bad when subjected to quality control standards to one familiar with the art.

Determining the amount of the emulsifier necessary for creating a specific emulsion of a water source and a hydrocarbon source can generally be calculated with calculations common to the art based on material densities, particle sizes of the discontinuous phase, etc. Such measurements are typically summarized in a particle distribution curve of the discontinued phase.

It is commonly recognized that aqueous fuel emulsions can by produced by mixing a liquid hydrocarbon source, an emulsifier source, and a water source. The art of making aqueous fuel emulsions basically relates to three aspects:

1) The specific sequences in which each of the ingredients (or portions thereof) are mixed with the other ingredients (or portions thereof),
2) The specific mechanical mixing procedures of the ingredients, and
3) The specific chemistries of the aqueous fuel emulsifier.

While a range of different sequences have been recognized, it is generally understood that the principles of aqueous fuel emulsions dictate that the emulsifier supply should be mixed with the external phase of the aqueous fuel emulsion first (or portions thereof) and then with the discontinued phase (or portions thereof) second.

For example, in the case of an oil-phased emulsion the emulsifier supply would be first mixed with the hydrocarbon source before it is mixed with the discontinued phase of water. Conversely, in a water-phased emulsion the emulsifier supply would be first mixed with the water source (or portions thereof) before it is mixed with the discontinued phase of oil (or portions thereof). In the case where portions are premixed, the balance is introduced at a subsequent point as the aqueous fuel emulsion is manufactured.

While there can be several mixing stations during the emulsification process, a high-shear mixing stage is usually required when a water source is mixed with an oil source. Prior to the high-shear mixing, the various stages can be mixed with less intense mixing devices, such as in-line mixers or other common liquid agitators, because the chemicals being mixed have relatively compatible chemical properties. Because of the very different chemical properties of water and oil, significant amounts of mechanical energy are required to reduce the discontinued phase to sizes where they can contribute to a stable aqueous fuel emulsion.

Chemistries for emulsifiers are generally composed of surfactants or soaps, among other things, that comprise a mixture of at least two components: one that is predominantly hydrocarbon soluble and the other that is predominantly water soluble so that the surfactant is balanced such that the interfacial tension between the hydrocarbon and water phases is substantially zero. In other words, each of these chemistries plays a critical role in breaking down the surface tension between the oil and water so a bond can form between the different molecules and to help disperse the water particles (from attracting to each other). This is basically completed through three different types of electrical charged chemistries referred to as cationic (positive charge), anionic (negative charge) and non-ionic (neutral charge), or combinations thereof.

In many cases the emulsifier packages are designed to be soluble in the discontinued phase. The amount of the emulsifier as a percent of the aqueous emulsified fuel will vary based on several factors which include the type and amount of continuous and discontinuous phase, the chemical composition of the emulsifier, and the particle sizes of the discontinued phase. What is needed in the art is a stable emulsifier package.

SUMMARY

The present invention is a method of manufacturing a fuel emulsifier package for blending an aqueous fuel emulsion from a source of hydrocarbon fuel, a source of water, and a source of an aqueous fuel emulsion emulsifiers Advantageously, the emulsifiers enhance the long-term and thermal stability of aqueous fuel emulsions over that of conventionally manufactured emulsifiers by incorporating a small area high velocity-mixing device that produces the appropriate mixing environment for the individual compounds of the individual ingredients of the emulsifier to interact.

A method for manufacturing an emulsifier package is disclosed. The method comprises blending a flow of fuel soluble product, a flow of stabilizer, and a flow of water in a mixing vessel to form a mixture. Mixing the mixture in the mixing vessel and recirculating the mixture through the mixing vessel. Lastly, shearing the mixture with a shearing device at a rate of about 27,500 shears per second to about 87,500 shears per second.

A method for manufacturing an aqueous fuel emulsion is also disclosed. The method comprises blending a flow of a liquid hydrocarbon fuel with a flow of an emulsifier package and a flow of water to form a first mixture. The emulsifier package is manufactured by the method comprising: blending a flow of fuel soluble product, a flow of stabilizer, and a flow of water in a mixing vessel to form an emulsifier mixture; mixing the emulsifier mixture in the mixing vessel; recirculating the emulsifier mixture through the mixing vessel; and shearing the emulsifier mixture with a shearing device at a rate of about 27,500 shears per second to about 87,500 shears per second. Next, the method comprises directing the first mixture into a mixing vessel and mixing the first mixture to form the aqueous fuel emulsion.

BRIEF DESCRIPTION OF THE FIGURES

Referring now to the figures, wherein like elements are numbered alike.

DETAILED DESCRIPTION

Those of ordinary skill in the art will realize that the following description is illustrative only and not in any way limiting. Other embodiments will readily suggest themselves to such skilled persons.

The present application incorporates by reference U.S. patent application Ser. No. 09/938,753, to which the present application claims priorty.

Figure 1:
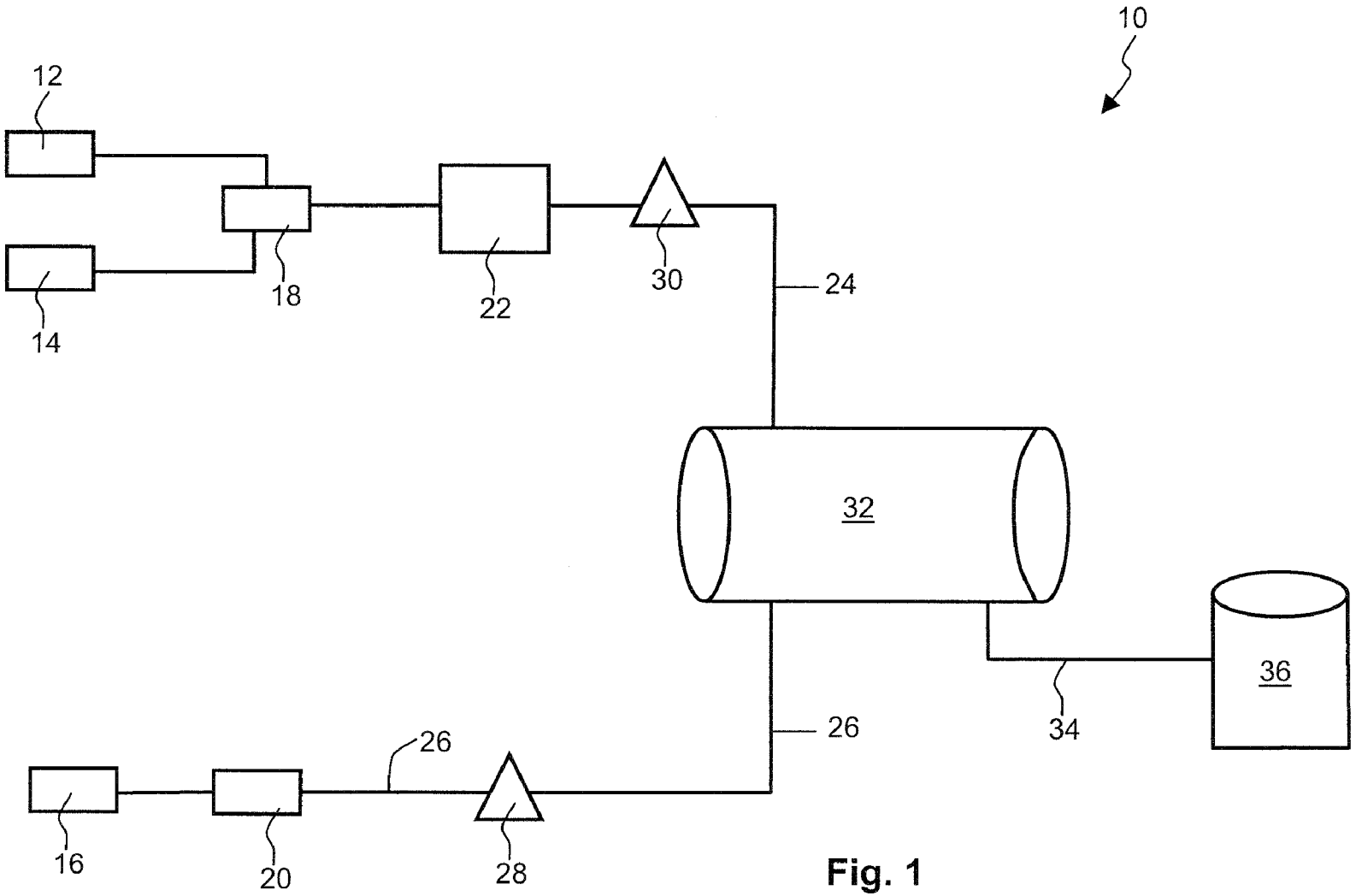
FIG. 1 is a schematic representation of a manufacturing system for an aqueous fuel emulsion.

FIG. 1 illustrates a schematic representation of a manufacturing system 10 for an emulsion. In the preferred embodiment, the manufacturing system operates at ambient conditions. The manufacturing system 10 comprises a series of inlets for the raw materials. For illustration purposes, inlet 12 provides a hydrocarbon fuel, inlet 14 provides an emulsifier package, and inlet 16 provides a source of water and can be connected to the mixing device 32 at an appropriate place.

Inlets 12 and 14 provide a hydrocarbon fuel and an emulsifier package, respectively, to a fuel pump 18 disposed at the intersection of inlets 12 and 14 with lead 24. The fuel pump 18 transfers the hydrocarbon fuel and the emulsifier package to a mixing station pump 22 at a selected flow rate. The hydrocarbon and emulsifier package would flow at a rate of about 0.87 gallons per minute (gpm) in an emulsifying system with a capacity of about 1 gpm. A flow measurement device 30 is adapted to control the flow of the hydrocarbon fuel and emulsifier package mixture directed from the mixing station pump 22 to the mixing device 32.

Inlet 16 provides a source of water to a water pump 20 through lead 26. The water pump 20 directs the source of water through a flow measurement device 28. The flow of water is then transferred to a mixing device 32 at a selected flow rate. The water would flow at a rate of about 0.13 gpm in an emulsifying system with a capacity of about 1 gpm.

After flowing through the flow measurement devices, leads 24 and 26 direct the materials to a mixing device 32. The materials may be transferred using existing pumps (as illustrated), using additional pumps (not shown), by gravity, or by other methods known in the art.

The mixing device 32 comprises a mixer (not illustrated) utilized in the industry including, but not limited to, mechanical mixer agitation, static mixers, shear mixers, sonic mixers, high-pressure homogenizers, and the like. Examples of such devices include but are not limited to rotor stator designed unit mixers by Silverson Corporation.

Following creation of the emulsion, the emulsion can be used immediately after manufacture or directed through a lead 34 to a holding tank 36 for future use.

Figure 2:
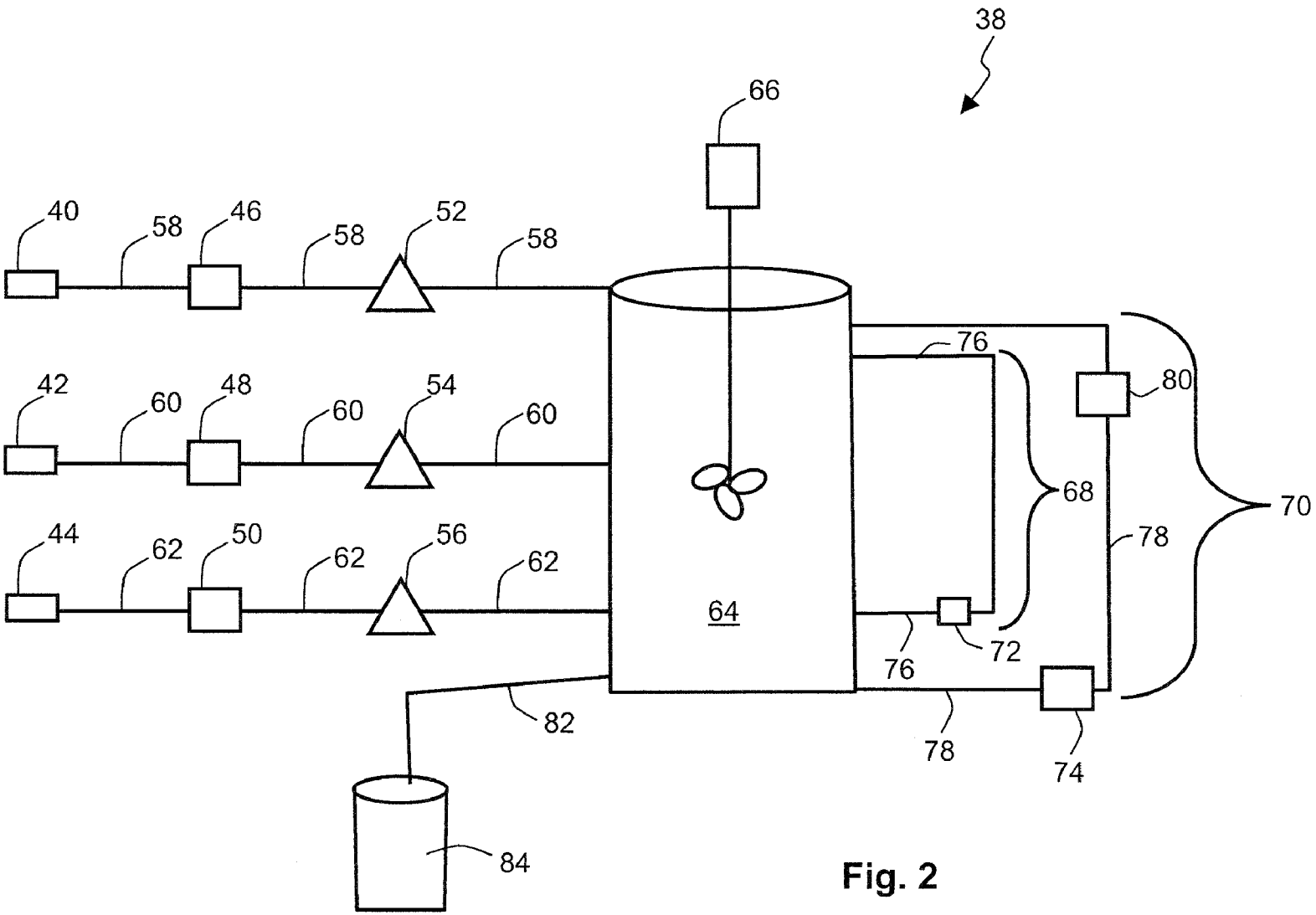
FIG. 2 is a schematic representation of a manufacturing system for an emulsifier package.

FIG. 2 illustrates a schematic representation of an emulsification package manufacturing system 38. In the preferred embodiment, the emulsification package manufacturing system 38 operates at ambient conditions. The emulsification package manufacturing system 38 comprises a series of inlets for the raw materials. For illustration purposes, inlet 40 provides a flow of a fuel soluble product, inlet 42 provides a flow of stabilizer, and inlet 44 provides a flow of water and can be connected to the mixing vessel 64 at an appropriate place.

Inlet 40 provides a flow of a fuel soluble product (e.g., a fatty acid) to lead 58 that is in fluid communication with pump 46. The pump 46 transfers the fuel soluble product along lead 58 to a mixing vessel 64 at a selected flow rate. A flow measurement device 52 is adapted to control the flow of the fuel soluble product to the mixing vessel 64. The fuel soluble product can flow at a rate of about 5 to about 8 gpm into the mixing vessel 64 with a capacity of about 50 gallons.

Inlet 42 provides a flow of a stabilizer (e.g., polyisobutylene) to lead 60 that is in fluid communication with pump 48. The pump 48 transfers the stabilizer along lead 60 to a mixing vessel 64 at a selected flow rate. A flow measurement device 54 is adapted to control the flow of the stabilizer to the mixing vessel 64. The stabilizer can flow at a rate of about 10 to about 13 gpm into the mixing vessel 64 with a capacity of about 50 gallons.

Inlet 44 provides a flow of water (e.g., ammonium based water) or reactant to lead 62 that is in fluid communication with pump 50. The pump 50 transfers the water along lead 62 to a mixing vessel 64 at a selected flow rate. A flow measurement device 56 is adapted to control the flow of the water to the mixing vessel 64. The water can flow at a rate of about 0.25 to about 0.75 gpm into a mixing vessel 64 with a capacity of about 50 gallons.

After flowing through the flow measurement devices, leads 58, 60, and 62 direct the materials to a mixing device 64. The materials may be transferred using existing pumps (as illustrated), using additional pumps (not shown), by gravity, or by other methods known in the art.

A mixer 66 is disposed within the mixing vessel 64 for mixing of the materials directed from inlets 40, 42, and 44.

A mixer 66 is disposed within the mixing vessel 64 for additional mixing of the fuel soluble product, the stabilizer, and the water. The emulsification package manufacturing system 38 is equipped with a recirculation system 68 and a shearing device system 70.

The recirculation system 68 directs the mixture through a system of pumps (only one pump 72 is illustrated) and leads (only one lead 76 is illustrated) from the mixing vessel 64 and redirects the mixture back into the mixing vessel 64 for further processing.

The shearing device system 70 comprises a high speed mixer 74 utilized in the liquid agitation industry including, but not limited to, mechanical mixer agitation, static mixers, shear mixers, sonic mixers, high-pressure homogenizers and the like. Examples of such devices include but are not limited to rotor stator designed unit mixers by Sliverson Corporation. Leads (only one lead 78 is illustrated) redirect the mixture back to the mixing vessel through a system of pumps (only one pump 80 is illustrated.)

Following creation of the emulsification package system, the emulsification package can be used immediately after manufacture or directed through a lead 82 to a holding tank 84 for future use.

Optionally, the fuel soluble raw materials referred to as fatty acid and polyisobutylene and water-soluble raw materials referred to as ammonium based water can be added at varying intervals and in varying sequence. Additionally, the mixing process could occur at temperatures slightly higher or slightly lower than ambient. The process can be controlled manually or through a control system. However, none of these examples are intended to be all inclusive.

A description of the preferred compounds to be utilized in making an aqueous fuel emulsion is as follows.

The liquid hydrocarbon fuel used in forming the aqueous hydrocarbon fuel emulsions may be any and all hydrocarbonaceous petroleum distillate fuels including, but not limited to, motor gasoline as defined by ASTM Specification D439, diesel fuel or fuel oil as defined by ASTM Specification D396, kerosene, naptha, aliphatics, paraffinics, and the like. The liquid hydrocarbon fuels comprising non-hydrocarbonaceous materials include, but are not limited to, alcohols such as methanol, ethanol and the like, ethers such as diethyl ether, methyl ethyl ether and the like, organo-nitro compounds and the like, and liquid fuels derived from vegetable sources (i.e., biodiesels) or mineral (i.e., mineral-derived fuels) sources such as corn, alfalfa, shale, coal and the like. The liquid hydrocarbon fuels can also include mixtures of one or more hydrocarbonaceous fuels and one or more non-hydrocarbonaceous materials. Examples of such mixtures are combinations of gasoline and ethanol, and combinations of diesel fuel and ether.

The emulsifier package used in forming the aqueous hydrocarbon fuel emulsions can include, but is not limited to, a combination in part or whole of a fuel soluble product, an ionic or nonionic compound, a water-soluble compound and a stabilizer.

The fuel soluble product is a derivative of a fatty acid that may contain about 12 to about 30 carbon atoms. Examples include, but are not limited to, myristic acid, palmitic acid, stearic acid, oleic acid, linoleic acids, linolenic acid, and the like, as well as combinations thereof. A preferred oleic acid is a technical grade available from Ashland Chemical Company under the name 213 Oleic Acid Technical.

The ionic or nonionic compound has a hydrophilic-lipophilic balance in the range of about 10 to about 20. Examples are disclosed in McCutheon's Emulsifiers and Detergents, 1998, North American & International Edition, and include, but are not limited to, block copolymers, ethoxylated nonyl phenols, ethoxylated fatty acids and esters, ethoxylated alkyl phenols, sorbitan derivatives and ethoxylated fatty acids, alcohols, and the like, as well as combinations thereof. A preferred ethoxylated nonyl phenol is IGEPAL® available from BASF.

The water-soluble compound may be an amine salt, ammonium salt, alkali salt, and the like, or some combination thereof. A preferred ammonium salt product is made by reacting at least one fatty acid derivative with water containing ammonia. The reaction between the fatty acid and the ammonium diluted with water is carried out under conditions that provide for the formation of the desired water-soluble product. Typically, the ammonium diluted with water and the fatty acid are mixed together at about ambient conditions and then subjected to a specific amount of mechanical agitation in the form of a shear mixing device and recirculation for given amount of time.

The stabilizer is derived from a poly isobutylene succinate compound. This compound can include anhydrides. A preferred poly isobtylene succinic compound is OLOA® 371 and is available from Chevron Oronite LLC.

The water used in forming the aqueous hydrocarbon fuel emulsions may be taken from any source. The water includes but is not limited to tap water, deionized water, demineralized water, and purified water. The purified water can be processed from any process, such as reverse osmosis, deionization, distillation, and the like.

Additionally, the fuel emulsion can contain additional components selected from a group comprising of dispersants, corrosion inhibitors, antioxidants, anti-rust agents, detergents, and lubricity agent. These additional components are fuel enhancement agents and do not necessarily effect the emulsion qualities of the emulsion fuel.

The mixture ratio of the components of the aqueous fuel emulsion is by weight percentage. In one embodiment, the weight percentage of the hydrocarbonaceous distillate fuel in the aqueous fuel emulsion is about 81% to about 99.5%. The weight percentage of emulsifier package in the aqueous fuel emulsion is about 0.5% to about 19%, preferably about 0.5% to about 5%. The weight percentage of water in the aqueous fuel emulsion is about 0.1% to about 18.5%.

In this embodiment, the mixture ratio of the components of the emulsifier package can be separated into components by weight percentage. The weight percentage of total water in the emulsifier package is about 10% to about 40% and the weight percentage of ammonium hydroxide in the water is about 0.5% to about 3%. The weight percentage of a mixture of fatty acids in the emulsifier package is about 50% to about 70%. The weight percent of polyanhydride in the emulsifier package is about 3% to about 15%.

In a preferred embodiment of the emulsifier package manufacturing system, the system comprises a series of inlets for the raw materials, a 50-gallon mixing tank (which is an open or closed system), a 3-blade propeller mixer, a gear pump driven recirculation system, and a rotor stator shearing system. The 50-gallon tank can have an open top, a rounded bottom, and a total depth of approximately 24-inches from top center to bottom center. There are no baffles in the mixing tank and it generally manufactures at a volume of approximately 70% of its capacity.

The mixer can be located offset from the center at a minor angle. The mixer is powered by a 1750 revolutions per minute (rpm) motor. During operation, the mixing rpm can be varied based on the volume of medium and the density of the medium (i.e., thickness). For example, when the medium is thick the motor can be set at about 30% to about 35% power efficiency (about 525 rpm to about 612 rpm). Whereas, if the volume level is low, or the medium is thin, the motor can be set at about 15% power efficiency (about 262 rpm).

The recirculation system can be comprised of a gear pump and a series of about 1-inch diameter hoses. The pump is a 2700-rpm motor. The motor is operated at about 75% to about 80% power efficiency. The tank acts as the beginning and ending sink for the media in the recirculation circuit. The media leaves the mixing tank from a valve positioned at the bottom front of the mixing tank and returns to the mixing tank at the top.

The rotor stator shearing system is an in-line mixer. A 1.5 horsepower motor with 3600 rpm powers it. The stator is a general purpose disintegrating head type. This stator is used for a wide range of applications and this head gives the greatest throughput. The stator has about 10 holes that act as a screen. Each hole measures about 0.36 inches (approx. ⅜") or about 9.5 mm in diameter. The rotor has four blades.

EXAMPLE 1

An aqueous fuel emulsion was created utilizing the following process. The aqueous fuel emulsion consisted of, by weight, about 13% of a water source, about 85% of a distillate No. 2 oil, and about 2% of an emulsifier package. The emulsifier package consisted of about 62.5% fatty acid compounds, about 7.5% polyisobutylene succinic compounds, and about 30% water-based ammonium compounds.

The fatty acid and polyisobutylene solution consists of two five-gallon containers that are used to manually feed the tank. While the sequence in which each of the raw materials is added is not necessarily relevant, the fatty acid based product is typically introduced first while both the mixer and recirculation systems are running because of the ease in which it flows through the system.

The water containing the ammonia is introduced from a 10-gallon tank via a micro-pump (2700 rpm motor), a flow meter and an injector head with valve. The introduction of the water-soluble emulsifier raw material begins the chemical reaction on the media, which is a saphonification (soaping) reaction. Chemical reaction and shearing occurs almost simultaneously. The rate of flow of water-soluble solution is about 1 liter per minute.

In one example, the following sequence was followed: fatty acid compound first, polyisobutylene compound second, and the water based ammonium compounds last.

When replicating these procedures and testing different operating parameters to increase capacity it was discovered that the mixing created by the shear mixer was critically important to manufacturing an emulsifier package that could produce a robust water-in-oil emulsion. In other words, the shearing step can be to gentle or too harsh for creating the optimum emulsifier package. It was discovered that emulsifier packages created by less than about 12,500 shears per second and more than about 87,500 shears per second consistently created water-in-oil emulsions that were not thermally stable and robust when tested. Preferably, the emulsifier package is created with about 12,500 shears per second to about 87,500 shears per second, with about 25,000 shears per second to about 70,500 shears per second more preferred, with about 40,000 shears per second to about 60,000 shears per second still more preferred, and with about 50,000 shears per second to about 55,000 shears per second most preferred.

Table 1 illustrates testing results of tests completed on emulsions having emulsifier packages mixed using a shearing device at separate rates. This information demonstrates how aqueous fuel emulsions manufactured with an emulsifier package insufficiently mixed will fail a range of standard tests common to those in the art. The same was true of aqueous fuels that were over-mixed. A description of each of the shearing rates is as follows: a "low shear" is less than about 12,500 shears per second (specifically, #1 is about 1,000 shears per second, #2 is about 5,000 shears per second, and #3 is about 10,000 shears per second); a medium shear is about 12,500 shears per second to about 87,500 shears per second (specifically, #1 is about 25,000 shears per second, #2 is about 50,000 shears per second, and #3 is about 75,000 shears per second); and a "high shear" is greater than about 87,500 shears per second (specifically, #1 is about 90,000 shears per second, #2 is about 100,000 shears per second, and #3 is about 110,000 shears per second).

The following presents a summary of the testing procedures utilized and illustrated in Table 1.

Procedure A

The aqueous fuel emulsion was placed in a 100 ml test tube and was placed in an ambient and static environment for 7 days. A "pass" indicates that free water (i.e., more than about 1 ml) was not noted and a "fail" indicates that free water (i.e., more than about 1 ml) was noted.

Procedure B

The aqueous fuel emulsion was placed in a 50 ml test tube and was placed in an ambient centrifuge for five minutes at 6,000 rpm. A "pass" indicates that free water (i.e., more than about 1 ml) was not noted and a "fail" indicates that free water (i.e., more than about 1 ml) was noted.

Procedure C

The aqueous fuel emulsion was placed in a 50 ml test tube and was placed in a heated centrifuge at a temperature of 170° F. for one minute at 1,000 rpm. A "pass" indicates that free water (i.e., more than about 1 ml) was not noted and a "fail" indicates that free water (i.e., more than about 1 ml) was noted.

Procedure D

The aqueous fuel emulsion was used in a 8.3 Cummings Stationary Engine at base loads of 1,200 rpm until the fuel was heated to about 100° F. to about 120° F. Samples of the aqueous fuel at the prescribed temperatures were gathered in 1,000 ml containers and were subsequently cooled to ambient conditions over night. After approximately 24 hours, the samples were subjected to Procedures A and B. Following applying Procedures A and B, a "pass" indicates that free water (i.e., more than about 1 ml) was not noted and a "fail" indicates that free water (i.e., more than about 1 ml) was noted.

Procedure E

The aqueous fuel emulsion was used to operate a standard commercial vehicle over a prescribed route, which includes no less than about 100 miles of road travel. Once the route was completed, the vehicle was parked for over a 48-hour period to simulate actual operator conditions. This allowed the aqueous fuel emulsion to settle in the vehicle tank, until the vehicle was started "cold" on the appropriate morning. A "pass" represents a vehicle start that had no delays in ignition timing and little to no smoke, and a "fail" represents a vehicle start that had smoke or delays in ignition timing.

TABLE 1

| | Static Stability A | Ambient Centrifuge B | Thermal Stability C | Engine Test D | Cold Start E |
|---|---|---|---|---|---|
| Low Shear #1 | Pass | Fail | Fail | Fail | Fail |
| Low Shear #2 | Pass | Pass | Fail | Fail | Fail |
| Low Shear #3 | Pass | Pass | Fail | Fail | Fail |
| Medium Shear #4 | Pass | Pass | Pass | Pass | Pass |
| Medium Shear #5 | Pass | Pass | Pass | Pass | Pass |
| Medium Shear #6 | Pass | Pass | Pass | Pass | Pass |
| High Shear #7 | Pass | Pass | Fail | Fail | Fail |
| High Shear #8 | Pass | Pass | Fail | Fail | Fail |
| High Shear #9 | Fail | Fail | Fail | Fail | Fail |

It is important to note that while aqueous fuel emulsions may appear very similar to the naked eye, the quality of the emulsion and its usefulness in a combustion chamber is generally determined through a cycle of tests that include stability and stress tests of the aqueous fuel emulsion. Therefore, the manufacture of the emulsifier package and the use of the emulsifier package in the created emulsion create an emulsion having superior properties, including superior storage, increased thermal stability and improved dynamic stability and usage.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for manufacturing an emulsifier package comprising:

blending a flow of fuel soluble product, a flow of stabilizer, and a flow of water in a mixing vessel to form a mixture wherein said water is substantially 13% of said mixture;

mixing said mixture in said mixing vessel;

recirculating said mixture through said mixing vessel; and shearing said mixture with a shearing device at a rate of about 27,500 shears per second to about 87,500 shears per second.

2. The method of claim 1, wherein said shearing device is selected from the group consisting of a high speed mixer, mechanical mixer agitation, static mixers, shear mixers, sonic mixers, and high pressure homogenizers.

3. The method of claim 1, wherein said water is selected from the group consisting of ammonium based water, tap water, deionized water, demineralized water, and purified water.

4. The method of claim 1, wherein said fuel soluble product is a derivative of a fatty acid.

5. The method of claim 4, wherein said fatty acid is selected from the group consisting of myristic acid, palmitic acid, stearic acid, oleic acid, linoleic acids, linolenic acid, and combinations thereof.

6. The method of claim 1, wherein said stabilizer is selected from the group consisting of polyisobutylene and poly isobutylene succinate anhydride compounds.

7. An emulsifier package manufactured by the method of claim 1.

8. A method for manufacturing an aqueous fuel emulsion comprising:

blending a flow of a liquid hydrocarbon fuel with a flow of an emulsifier package and a flow of water to form a first mixture, said emulsifier package manufactured by a method comprising:

blending a flow of a fuel soluble product, a flow of a stabilizer, and a flow of a first water in a mixing vessel to form an emulsifier mixture wherein said water is substantially 13% of said mixture;

mixing said emulsifier mixture in said mixing vessel; and recirculating said emulsifier mixture through said mixing vessel; and shearing said emulsifier mixture with a shearing device at a rate of about 27,500 shears per second to about 87,500 shears per second;

directing said first mixture into a mixing vessel; and mixing said first mixture to form the aqueous fuel emulsion.

9. The method of claim 8, wherein said mixing vessel is equipped with a mixing device.

10. The method of claim 9, wherein said mixing device is selected from the group consisting of a high speed mixer, mechanical mixer agitation, static mixers, shear mixers, sonic mixers, and high pressure homogenizers.

11. The method of claim 8, wherein said first water is selected from the group consisting of ammonium based water, tap water, deionized water, demineralized water, and purified water.

12. The method of claim 8, wherein said fuel soluble product is a derivative of a fatty acid.

13. The method of claim 12, wherein said fatty acid is selected from the group consisting of myristic acid, palmitic acid, stearic acid, oleic acid, linoleic acids, linolenic acid, and combinations thereof.

14. The method of claim 8, wherein said stabilizer is selected from the group consisting of polyisobutylene and a poly isobutylene succinate compound.

15. The method of claim 8, wherein said fuel is a hydrocarbonaceous petroleum distillate fuel.

16. The method of claim 15, wherein said hydrocarbonaceous petroleum distillate fuel is selected from the group consisting of motor gasoline, diesel fuel, fuel oil, kerosene, naptha, aliphatics, and paraffinics.

17. The method of claim 8, wherein said fuel is a non-hydrocarbonaceous fuel.

18. The method of claim 17, wherein said non-hydrocarbonaceous fuel is selected from the group consisting of methanol, ethanol, diethyl ether, methyl ethyl ether, organonitro compounds, biodiesels, and mineral-derived fuels.

19. The method of claim 8, wherein said second water is selected from the group consisting of tap water, deionized water, demineralized water, and purified water.

20. The method of claim 8, wherein said second mixture further comprises compounds selected from the group consisting of dispersants, corrosion inhibitors, antioxidants, anti-rust agents, detergents, and lubricity agents.

21. An emulsified fuel manufactured by the method of claim 8.

* * * * *